US008829795B2

(12) United States Patent
Yang

(10) Patent No.: US 8,829,795 B2
(45) Date of Patent: Sep. 9, 2014

(54) ELECTRIC AXIAL-FLOW FAN HAVING TURBINE TYPE WATERPROOF ENCLOSURE AND APPLICATION THEREOF

(76) Inventor: Tai-Her Yang, Dzan-Hwa (TW)

( * ) Notice: Subject to any disclaimer, the term of this patent is extended or adjusted under 35 U.S.C. 154(b) by 0 days.

(21) Appl. No.: 13/219,743

(22) Filed: Aug. 29, 2011

(65) Prior Publication Data

US 2013/0049594 A1 Feb. 28, 2013

(51) Int. Cl.

| | |
|---|---|
| ***H05B 37/02*** | (2006.01) |
| ***F21V 13/10*** | (2006.01) |
| ***F21V 33/00*** | (2006.01) |
| ***F21V 29/02*** | (2006.01) |
| *F21V 31/00* | (2006.01) |
| *F21V 23/04* | (2006.01) |
| *F21Y 101/02* | (2006.01) |

(52) U.S. Cl.

CPC ..... *F21V 33/0096* (2013.01); *F21V 31/005* (2013.01); *F21V 23/04* (2013.01); *F21V 29/027* (2013.01); *F21Y 2101/02* (2013.01)

USPC ..... 315/112; 315/113; 315/114; 315/115; 315/116; 315/117; 362/373; 362/343

(58) Field of Classification Search

CPC ..... H05B 37/02; F21V 13/10; F21V 29/02

USPC ..... 315/112, 113, 114, 115, 116, 117, 118

See application file for complete search history.

(56) References Cited

U.S. PATENT DOCUMENTS

| | | | | |
|---|---|---|---|---|
| 3,910,717 | A * | 10/1975 | Thome | 415/229 |
| 5,664,872 | A * | 9/1997 | Spearman et al. | 362/96 |
| 8,267,555 | B1 * | 9/2012 | Tsai | 362/373 |
| 2004/0066142 | A1 * | 4/2004 | Stimac et al. | 315/50 |
| 2012/0086340 | A1 * | 4/2012 | Hashizume | 315/112 |

* cited by examiner

*Primary Examiner* — Douglas W Owens
*Assistant Examiner* — Jonathan Cooper
(74) *Attorney, Agent, or Firm* — Bacon & Thomas, PLLC

(57) ABSTRACT

The present invention provides an electric axial-flow fan having turbine type waterproof enclosure, which is rainproof and installed at the top portion of sealed heat dissipation housing of a high power lamp, so when the electric axial-flow fan is operated, the airflow passes through the top portion of lamp housing, which is relatively hotter, of the sealed heat dissipation housing and is concentrated towards the center, then leaded to upwardly enter an axial airflow inlet port formed at the bottom of the turbine type waterproof enclosure, thereby being exhausted to the surroundings through radially-arranged exhaust blades, thus when the present invention being applied in a high power lamp, an air cooling effect by external airflow can be provided to the top portion, which is relatively hotter, of the lamp housing, without influencing the waterproof sealing effect.

16 Claims, 3 Drawing Sheets

ELECTRIC AXIAL-FLOW FAN HAVING TURBINE TYPE WATERPROOF ENCLOSURE AND APPLICATION THEREOF

BACKGROUND OF THE INVENTION (a) Field of the Invention

A conventional turbine type axial-flow fan thermally actuated or driven by wind power is equipped with a sealed top portion having plural radially-arranged exhaust blades arranged at intervals and stacked with equal inclined angles annularly installed at its periphery, the center thereof is downwardly extended with an axial airflow inlet port; when wind power is not available, an electric axial-flow fan is used to pump airflows through the axial airflow inlet port to the interior of a turbine type waterproof enclosure, the turbine formed by the exhaust blades can be driven to rotate for exhausting the airflow, which is pumped in from the axial airflow inlet port, to the surroundings;

At present, a heat generation device installed in the interior of a sealed space, e.g. a high power lamp set, often adopts a heat dissipation housing having a sealed top portion and made of a heat conductive material for facilitating heat to be upwardly dissipated and preventing rainwater from entering. The present invention installs an electric axial-flow fan, which is driven by electric power, on the top portion of heat dissipation housing of a lamp, for supplying airflow to the interior of a turbine type waterproof enclosure, so when the electric axial-flow fan is operated, the airflow is concentrated from the exterior of top portion of lamp housing, which is relatively hotter, of the sealed heat dissipation housing towards the center, and leaded to upwardly enter an axial airflow inlet port formed at the bottom of the turbine type waterproof enclosure, thereby being exhausted to the surroundings through the radially-arranged exhaust blades of the turbine type waterproof enclosure; thus when the present invention being applied in a high power lamp, e.g. a high power LED lamp set, an air cooling effect by external airflow can be provided to the top portion, which is relatively hotter, of the LED lamp housing without influencing the waterproof sealing effect; when the turbine type waterproof enclosure is driven to rotate by the external wind power, the flow exhaust and heat dissipation effect can be further enhanced.

(b) Description of the Prior Art

The cooling for a conventional LED lamp housing includes natural air cooling or fan cooling, wherein the rainproof effect for the fan cooling is relatively harder to establish, it is yet to be seen a lamp housing having its top portion installed with an electric axial-flow fan having turbine type waterproof enclosure for providing air cooling by external airflow and having a waterproof function.

SUMMARY OF THE INVENTION

The present invention provides an electric axial-flow fan having turbine type waterproof enclosure, which is rainproof and installed at the top portion of sealed heat dissipation housing of a high power lamp, so when the electric axial-flow fan is operated, airflow passes through the top portion of lamp housing, which is relatively hotter, of the sealed heat dissipation housing and is concentrated towards the center, then leaded to upwardly enter an axial airflow inlet port formed at the bottom of the turbine type waterproof enclosure, thereby being exhausted to the surroundings through radially-arranged exhaust blades, thus when the present invention being applied in a high power lamp, an air cooling effect by external airflow can be provided to the top portion, which is relatively hotter, of the lamp housing, without influencing the waterproof sealing effect.

DESCRIPTION OF MAIN COMPONENT SYMBOLS

Figure 1:
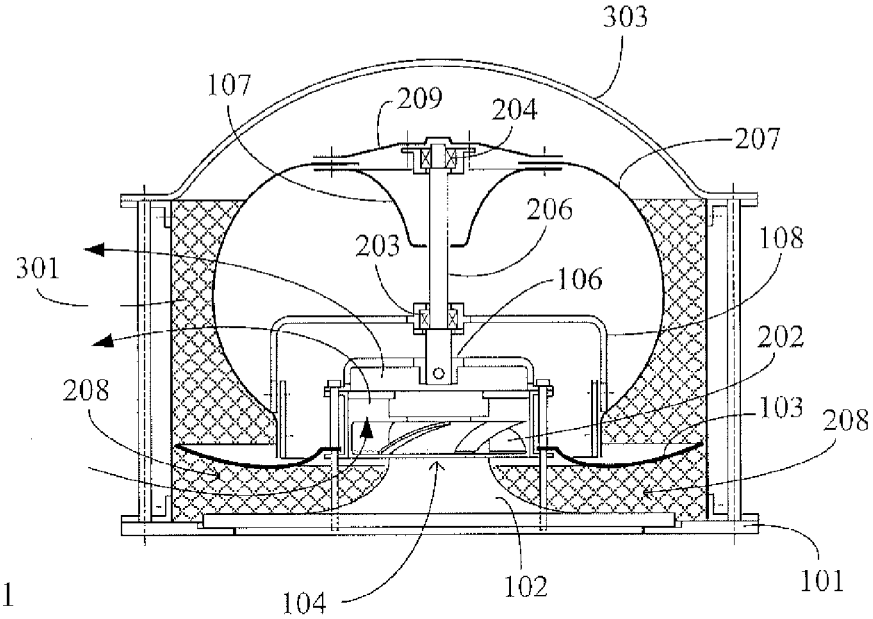
FIG. 1 is a schematic structural view showing the electric axial-flow fan having turbine type waterproof enclosure, according to the present invention.

100: Support body
101: Heat source housing
102: Heat dissipation structure
103: Annular arc-shaped airflow guide plate
104: Top portion of heat dissipation structure
106: Fasten seat
107: Flow guide cone
108: Spoke-shaped round disc connection structure
202: Electric axial-flow fan
203, 204: Bearing
206: Fasten core shaft
207: Radially-arranged exhaust blade
208: Annular axial fluid inlet port
209: Sealed top cover
301: Net cover
303: Sealed top cover
304: Heat source device
305: Temperature switch
306: Light emitting device
307: Annular reflection device
308: Light-pervious lampshade
309: Light-pervious base seat
310: Housing of heat source device

DETAILED DESCRIPTION OF THE PREFERRED EMBODIMENTS

The cooling for a conventional LED lamp housing includes natural air cooling or fan cooling, wherein the rainproof effect for the fan cooling is relatively harder to establish, it is yet to be seen a lamp housing having its top portion installed with an electric axial-flow fan having turbine type waterproof enclosure for providing air cooling by external airflow and having a waterproof function.

A conventional turbine type axial-flow fan thermally actuated or driven by wind power is equipped with a sealed top portion having plural radially-arranged exhaust blades arranged at intervals and stacked with equal inclined angles annularly installed at its periphery, the center thereof is downwardly extended with an axial airflow inlet port; when wind power is not available, an electric axial-flow fan is used to pump airflows through the axial airflow inlet port to the interior of a turbine type waterproof enclosure, the turbine formed by the exhaust blades can be driven to rotate for exhausting the airflow, which is pumped in from the axial airflow inlet port, to the surroundings;

At present, a heat generation device installed in the interior of a sealed space, e.g. a high power lamp set, often adopts a heat dissipation housing having a sealed top portion and made of a heat conductive material for facilitating heat to be upwardly dissipated and preventing rainwater from entering. The present invention installs an electric axial-flow fan, which is driven by electric power, on the top portion of heat dissipation housing of a lamp, for supplying airflow to the interior of a turbine type waterproof enclosure, so when the electric axial-flow fan is operated, the airflow is concentrated from the exterior of top portion of lamp housing, which is relatively hotter, of the sealed heat dissipation housing towards the center, and leaded to upwardly enter an axial airflow inlet port formed at the bottom of the turbine type waterproof enclosure, thereby being exhausted to the surroundings through the radially-arranged exhaust blades of the turbine type waterproof enclosure; thus when the present invention being applied in a high power lamp, e.g. a high power LED lamp set, an air cooling effect by external airflow can be provided to the top portion, which is relatively hotter, of the LED lamp housing without influencing the waterproof sealing effect; when the turbine type waterproof enclosure is driven to rotate by the external wind power, the flow exhaust and heat dissipation effect can be further enhanced.

Figure 2:
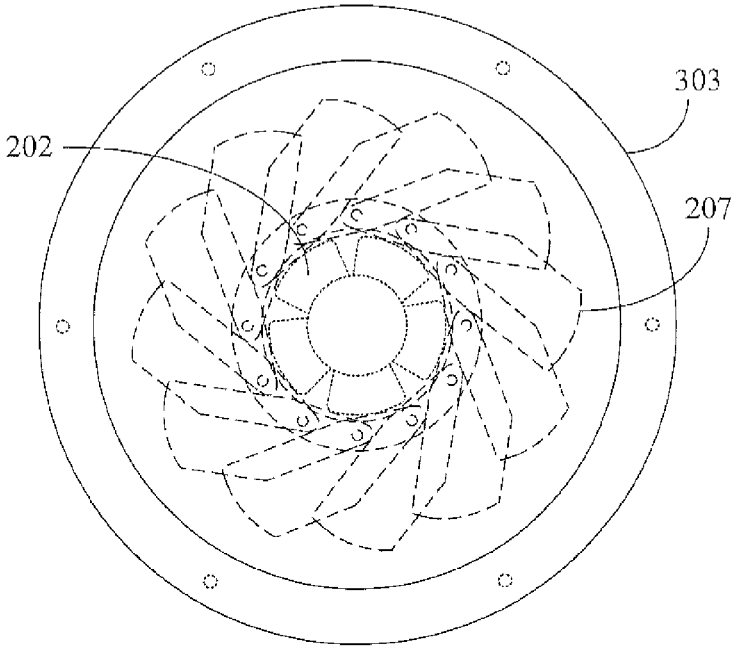
FIG. 2 is a top view of FIG. 1.

FIG. 1 is a schematic structural view showing the electric axial-flow fan having turbine type waterproof enclosure, according to the present invention, and FIG. 2 is a top view of FIG. 1, which mainly consists of:

Heat source housing (101): made of a heat conductive or non-heat conductive member, wherein the central portion is made of a heat conductive material, formed with a round or conical heat dissipation structure (102) having vertical radial blades, the heat dissipation structure (102) can be integrally formed with the heat source housing (101) or individually manufactured then assembled as one piece, the bottom of the heat dissipation structure (102) receives the external heat energy, the heat source housing (101) is formed with an annular arc-shaped airflow guide plate (103) along the periphery of the heat dissipation structure (102) and the bottom of an electric axial-flow fan (202);

Electric axial-flow fan (202): constituted by a built-in electric motor and axial-flow blades driven by the electric motor, the bottom is installed close to the top portion of heat dissipation structure (104), and the top of the electric axial-flow fan (202) is installed with a fasten seat (106), the bottom of the electric axial-flow fan (202) is installed with the annular arc-shaped airflow guide plate (103), the above two components and the electric axial-flow fan (202) are jointly fastened on the heat dissipation structure (102), the center of the fasten seat (106) has a fasten core shaft (206) which is upwardly extended and annularly connected to the bottom of the radially-arranged exhaust blades (207) of the turbine type waterproof enclosure through a bearing (203) and a spoke-shaped round disc connection structure (108), and upwardly extended and combined with a sealed top cover (209) through a bearing (204), and the top of radially-arranged exhaust blades (207) is combined inside the sealed top cover (209) installed at the top of the turbine type waterproof enclosure and having a flow guide cone (107), and the bottom of the electric axial-flow fan (202) is formed with an annular axial fluid inlet port (208), thereby through the pumping of the electric axial-flow fan (202), the airflow passing the annular arc-shaped airflow guide plate (103) and passing the top periphery of the heat dissipation structure (102) is guided to enter the interior of the turbine type waterproof enclosure then is exhausted to the surroundings through the radially-arranged exhaust blades (207); the top of the turbine type waterproof enclosure is installed with the sealed top cover (209) for providing protection to the electric axial-flow fan (202);

The source of external heat energy received by the bottom of the mentioned heat dissipation structure (102) includes one or more than one of the following heat energy sources, including:

1) DC light emitting diode;
2) AC light emitting diode;
3) Gaseous lamp set;
4) Fluorescent lamp;
5) Lamp bulb;
6) Heat source of electrothermal device;
7) Chemical heat source;
8) Combustion heat source;
9) Heat source of radiant heat device;
10) Vapor or gaseous heat source;
11) Liquid heat source such as water or oil;
12) Natural heat source;

Net cover (301): constituted by a net structure for covering and protecting the electric axial-flow fan (202) and fastened on the heat source housing (101); the top thereof is configured by the net cover (301) or configured by installing a sealed top cover (303).

Figure 3:
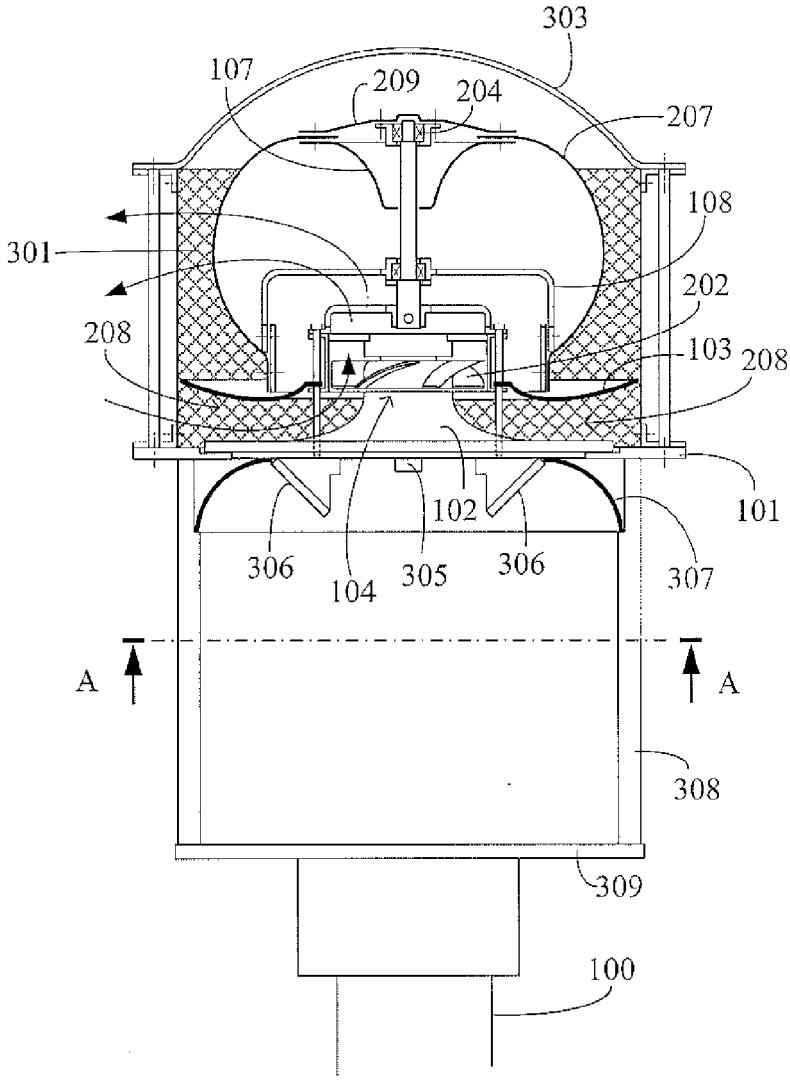
FIG. 3 is a schematic view showing the application for dissipating heat energy of the light emitting device (306) of a lamp structure, according to the present invention.
Figure 4:
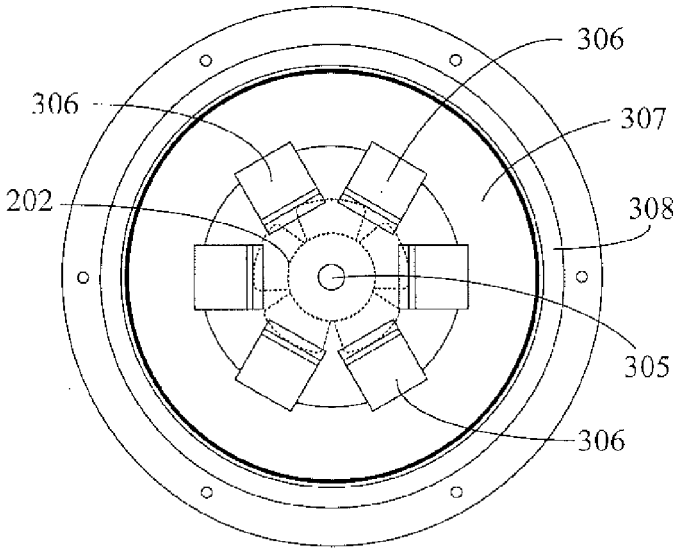
FIG. 4 is a cross sectional view of FIG. 3 taken along lines A-A.

According to the present invention, the electric axial-flow fan having turbine type waterproof enclosure and application thereof can be further utilized to dissipate the heat energy of a light emitting device (306) to the surroundings;

FIG. 3 is a schematic view showing the application for dissipating heat energy of the light emitting device (306) of a lamp structure, according to the present invention, FIG. 4 is a cross sectional view of FIG. 3 taken along line A-A, which mainly consist of:

Heat source housing (101): made of a heat conductive or non-heat conductive member, wherein the central portion is made of a heat conductive material, formed with a round or conical heat dissipation structure (102) having vertical radial blades, the heat dissipation structure (102) can be integrally formed with the heat source housing (101) or individually manufactured then assembled as one piece, the bottom of the heat dissipation structure (102) is used for the installation of a light emitting device (306), e.g. LED, the heat source housing (101) is formed with an annular arc-shaped airflow guide plate (103) along the periphery of the heat dissipation structure (102) and the bottom of an electric axial-flow fan (202); the heat source housing (101), a light-pervious lampshade (308) and a light-pervious base seat (309) are combined with a support body (100);

Electric axial-flow fan (202): constituted by a built-in electric motor and axial-flow blades driven by the electric motor, the bottom is installed close to the top portion of heat dissipation structure (104), and the top of the electric axial-flow fan (202) is installed with a fasten seat (106), the bottom of the electric axial-flow fan (202) is installed with the annular arc-shaped airflow guide plate (103), the above two components and the electric axial-flow fan (202) are jointly fastened on the heat dissipation structure (102), the center of the fasten seat (106) has a fasten core shaft (206) which is upwardly extended and annularly connected to the bottom of the radially-arranged exhaust blades (207) of the turbine type waterproof enclosure through a bearing (203) and a spoke-shaped round disc connection structure (108), and upwardly extended and combined with a sealed top cover (209) through a bearing (204), and the top of radially-arranged exhaust blades (207) is combined inside the sealed top cover (209) installed at the top of the turbine type waterproof enclosure and having a flow guide cone (107), and the bottom of the electric axial-flow fan (202) is formed with an annular axial fluid inlet port (208), thereby through the pumping of the electric axial-flow fan (202), the airflow passing the annular arc-shaped airflow guide plate (103) and passing the top periphery of the heat dissipation structure (102) is guided to enter the interior of the turbine type waterproof enclosure then is exhausted to the surroundings through the radially-arranged exhaust blades (207); the top of the turbine type waterproof enclosure is installed with the sealed top cover (209) for providing protection to the electric axial-flow fan (202);

Light emitting device (306): constituted by one or more than one of following light emitting lamps driven by the electric energy and capable of synchronously generating optical energy and heat energy through utilizing electric energy, including:

1) DC light emitting diode;
2) AC light emitting diode;
3) Gaseous lamp set;
4) Fluorescent lamp;
5) Lamp bulb;

Annular reflection device (307): constituted by a device capable of reflecting or refracting, or focusing or diffusing the vehicle light; provided for receiving the light from the light emitting device (306) so as to project to the surroundings;

Light-pervious lampshade (308): installed at the periphery of the lamp without influencing the light emitting device (306) for projecting light to the surroundings through the annular reflection device (307);

Light-pervious base seat (309): installed at the bottom of the lamp for connecting with a support body (100);

Net cover (301): constituted by a net structure for covering and protecting the electric axial-flow fan (202) and fastened on the heat source housing (101); the top thereof is configured by the net cover (301) or configured by installing a sealed top cover (303).

The electric axial-flow fan having turbine type waterproof enclosure and application thereof shown in FIG. 3 and FIG. 4 can be further installed with a temperature switch (305), for monitoring the temperature rising of the light emitting device (306), which is driven by electric energy, wherein:

Temperature switch (305): constituted by an electromechanical joint switch configured by electrical mechanic or dual metal sheets or memory alloy, or constituted by a solid-state switch device driven by thermistor or thermalcouple, wherein one or more than one temperature switches (305) are installed at locations close to the location where the light emitting device (306) being installed on the heat dissipation structure (102), so when the temperature generated by the light emitting device (306) transmitted to the temperature switch (305) installed on the heat dissipation structure (102) exceeds a preset temperature value, the power source controlling the whole or a part of the light emitting device (306) is cut off for preventing the light emitting device (306) from being overheated and damaged.

Figure 5:
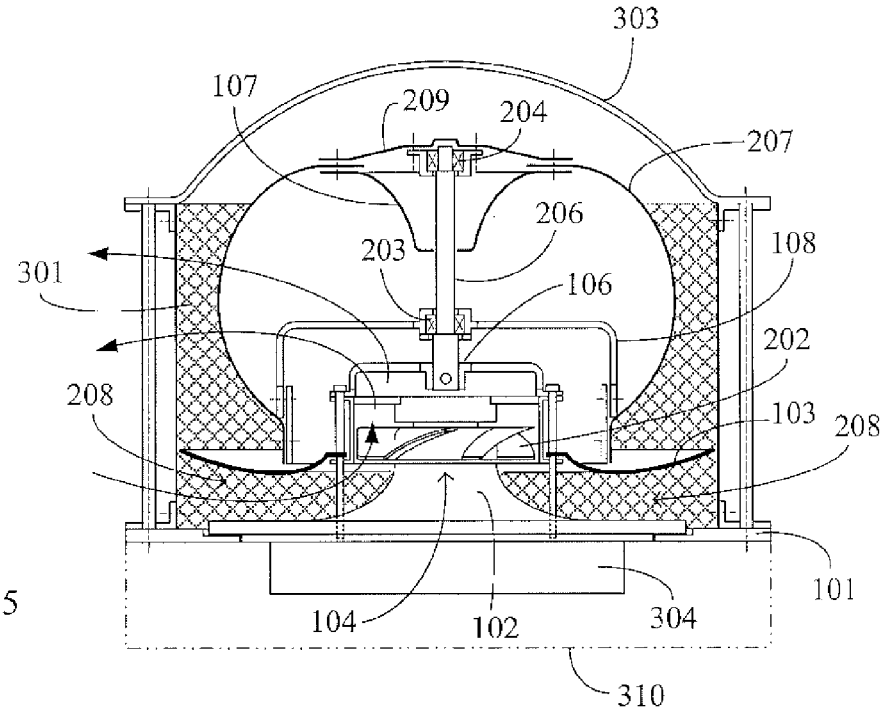
FIG. 5 is a schematic view showing the application for dissipating heat energy of the heat source device (304), according to the present invention.
Figure 6:
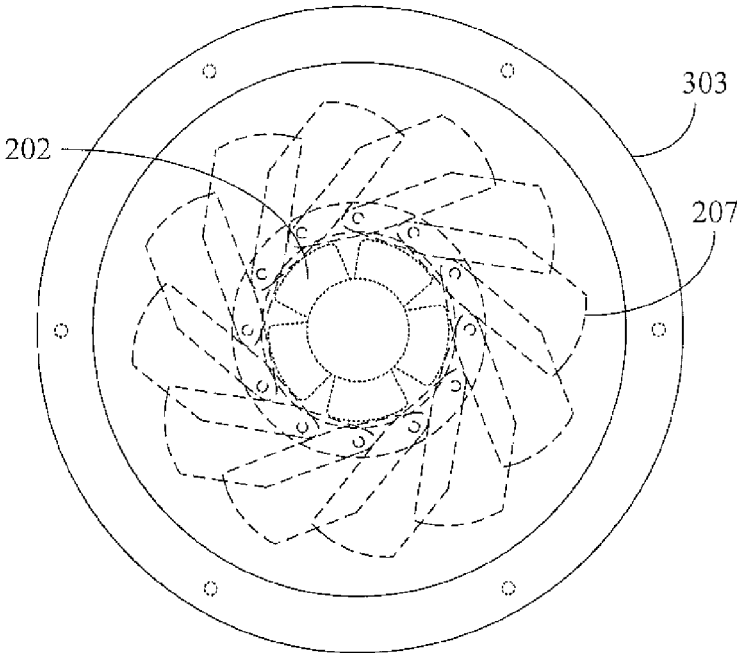
FIG. 6 is a top view of FIG. 5.

According to the present invention, the electric axial-flow fan having turbine type waterproof enclosure and application thereof can be further utilized to dissipate the heat energy of a heat source device (304) to the exterior;

FIG. 5 is a schematic view showing the application for dissipating heat energy of the heat source device (304), according to the present invention; FIG. 6 is a top view of FIG. 5.

As shown in FIG. 5 and FIG. 6, which mainly consist of:

Heat source housing (101): made of a heat conductive or non-heat conductive member, wherein the central portion is made of a heat conductive material, formed with a round or conical heat dissipation structure (102) having vertical radial blades, the heat dissipation structure (102) can be integrally formed with the heat source housing (101) or individually manufactured then assembled as one piece, the bottom of the heat dissipation structure (102) is used for the installation of a heat source device (304), the heat source housing (101) is formed with an annular arc-shaped airflow guide plate (103) along the periphery of the heat dissipation structure (102) and the bottom of an electric axial-flow fan (202);

Electric axial-flow fan (202): constituted by a built-in electric motor and axial-flow blades driven by the electric motor, the bottom is installed close to the top portion of heat dissipation structure (104), and the top of the electric axial-flow fan (202) is installed with a fasten seat (106), the bottom of the electric axial-flow fan (202) is installed with the annular arc-shaped airflow guide plate (103), the above two components and the electric axial-flow fan (202) are jointly fastened on the heat dissipation structure (102), the center of the fasten seat (106) has a fasten core shaft (206) which is upwardly extended and annularly connected to the bottom of the radially-arranged exhaust blades (207) of the turbine type waterproof enclosure through a bearing (203) and a spoke-shaped round disc connection structure (108), and upwardly extended and combined with a sealed top cover (209) through a bearing (204), and the top of radially-arranged exhaust blades (207) is combined inside the sealed top cover (209) installed at the top of the turbine type waterproof enclosure and having a flow guide cone (107), and the bottom of the electric axial-flow fan (202) is formed with an annular axial fluid inlet port (208), thereby through the pumping of the electric axial-flow fan (202), the airflow passing the annular arc-shaped airflow guide plate (103) and passing the top periphery of the heat dissipation structure (102) is guided to enter the interior of the turbine type waterproof enclosure then is exhausted to the surroundings through the radially-arranged exhaust blades (207); the top of the turbine type waterproof enclosure is installed with the sealed top cover (209) for providing protection to the electric axial-flow fan (202);

Heat source device (304): constituted by one or more than one of the following heat source devices (304), including:

1) Heat source of electrothermal device;
2) Chemical heat source;
3) Combustion heat source;
4) Heat source of radiant heat device;
5) Vapor or gaseous heat source;
6) Liquid heat source such as water or oil;
7) Natural heat source;

Housing of heat source device (310): constituted by a sealed or semi-sealed structural body, allowing the heat source device (304) to be installed therein;

Net cover (301): constituted by a net structure for covering and protecting the electric axial-flow fan (202) and fastened on the heat source housing (101); the top thereof is configured by the net cover (301) or configured by installing a sealed top cover (303).

The electric axial-flow fan having turbine type waterproof enclosure and application thereof shown in FIG. 5 and FIG. 6 can be further installed with a temperature switch (305), for monitoring the temperature rising of the heat source device (304), wherein:

Temperature switch (305): constituted by an electromechanical joint switch configured by electrical mechanic or dual metal sheets or memory alloy, or constituted by a solid-state switch device driven by thermistor or thermalcouple, wherein one or more than one temperature switches (305) are installed at locations close to the location where the heat source device (304) being installed on the heat dissipation structure (102), so when the temperature generated by the heat source device (304) transmitted to the temperature switch (305) installed on the heat dissipation structure (102) exceeds a preset temperature value, the operation of the whole or a part of the controlled heat source device (304) is cut off for preventing the heat source device (304) from being overheated and damaged.

The invention claimed is:

1. An axial-flow fan assembly having a turbine type enclosure, comprising:

a first heat dissipation structure (102) positioned at a top of a heat source housing (101) for receiving external heat energy from the heat source housing (101);

an annular arc-shaped guide plate (103) extending around a periphery of the heat dissipation structure (102);

an electric axial-flow fan (202) installed adjacent a top portion (104) of the heat dissipation structure (102), said annular arcuate guide plate (103) extending around a bottom of the electric axial-flow fan (202), said electric axial-flow fan (202) including a fastening seat (106) installed at a top of the axial-flow fan (202);

a fastening core shaft (206) installed at a center of and extending upwardly from the fastening seat (106) at the top of the axial-flow fan (202);

radially-arranged exhaust blades (207) mounted to the fastening core shaft (206) and rotatable in response to upward flow of a fluid pumped by the axial-flow fan (202) in an axially upward direction, the rotating exhaust blades (207) directing the upwardly flowing fluid pumped by the axial-flow fan in a radially outward direction towards an exterior of the turbine type enclosure;

a flow guide cone (107) within the sealed top cover (209) and combined with tops of the radially-arranged exhaust blades (207); and an annular axial fluid inlet port (208) at a bottom of the axial-flow fan (202) and extending between the heat dissipation structure (102) and the annular arc-shaped guide plate (103) to guide the fluid in a radially inward direction from the exterior of the turbine type enclosure past the heat dissipation structure (102) to the axial-flow fan, said axial-flow fan pumping the fluid in said axially upward direction to the radially-arranged exhaust blades (207), and the radially-arranged exhaust blades (207) directing the pumped fluid in said radially outward direction back to the exterior of the turbine type enclosure.

2. An axial-flow fan assembly having a turbine type enclosure as claimed in claim 1, wherein the fluid is air.

3. An axial-flow fan assembly having a turbine type enclosure as claimed in claim 1, wherein the turbine type enclosure is a waterproof enclosure.

4. An axial-flow fan assembly having a turbine type enclosure as claimed in claim 1, wherein the heat dissipation structure (102) is integrally formed with or assembled to the heat source housing (101).

5. An axial-flow fan assembly having a turbine type enclosure as claimed in claim 1, wherein:

bottoms of the radially-arranged exhaust blades (207) are rotatably mounted to a bottom of the upwardly extending fastening core shaft (206) by a first bearing (203) and spoke-shaped disc connection structure (108), and tops of the radially-arranged exhaust blades (207) are rotatably mounted to the upwardly extending fastening core shaft (206) by a second bearing (204) and a sealed top cover (209).

6. An axial-flow fan assembly having a turbine type enclosure as claimed in claim 1, wherein the heat source housing (101) is a housing for at least one of the following heat sources:

a DC or AC light emitting diode;
a gaseous lamp set;
a fluorescent lamp;
a light bulb;
a heat source of an electrothermal device;
a chemical heat source:
a combustion heat source;
a heat source of a radiant heat device;
a vapor or gaseous heat source;
a liquid heat source; and
a natural heat source.

7. An axial-flow fan assembly having a turbine type enclosure as claimed in claim 1, wherein the heat source housing (101) is a lamp housing.

8. An axial-flow fan assembly having a turbine type enclosure as claimed in claim 1, wherein the heat source housing (101) is a housing of a light emitting device (306), the heat source housing (101) being combined with a light-pervious lampshade (308) and light pervious base seat (309) supported by a support body (100) to form a lamp structure, said axial-flow fan assembly and turbine type enclosure being provide at a top of the lamp structure.

9. An axial-flow fan assembly having a turbine type enclosure as claimed in claim 8, wherein the light emitting device (306) is at least one of:

a DC or AC light emitting diode;
a gaseous lamp set;
a fluorescent lamp; and
a light bulb.

10. An axial-flow fan assembly having a turbine type enclosure as claimed in claim 8, further comprising an annular reflection device for directing light from the light emitting device (306) through the lampshade (308) to surroundings of the lamp structure.

11. An axial-flow fan assembly having a turbine type enclosure as claimed in claim 8, further comprising a temperature switch (305) installed on the heat dissipation structure (102) for monitoring temperature changes within the light emitting device (306) and for cutting off power to the light emitting device (306) when a detected temperature exceeds a predetermined temperature.

12. An axial-flow fan assembly having a turbine type enclosure as claimed in claim 1, wherein the heat source housing (101) is a housing for a heat source device (304) that includes at least one of the following heat sources:

a heat source of an electrothermal device;

a chemical heat source:
a combustion heat source;
a heat source of a radiant heat device;
a vapor or gaseous heat source;
a liquid heat source; and
a natural heat source.

13. An axial-flow fan assembly having a turbine type enclosure as claimed in claim 1, wherein the heat source housing (101) is a sealed housing (310) of a heat source device (304).

14. An axial-flow fan assembly having a turbine type enclosure as claimed in claim 13, further comprising a temperature switch (305) installed on the heat dissipation structure (102) for monitoring temperature changes within the heat source device (304) and for cutting off power to the heat source device (304) when a detected temperature exceeds a predetermined temperature.

15. An axial-flow fan assembly having a turbine type enclosure as claimed in claim 1, 7, or 13, wherein the turbine type enclosure includes at least one of a net cover (301) and a sealed top cover (303) for covering and protecting the axial-flow fan.

16. An axial-flow fan assembly having a turbine type enclosure as claimed in claim 1, wherein the heat dissipation structure (102) is one of a round structure and a conical structure.

* * * * *